US007141810B2

(12) United States Patent
Kakiuchi et al.

(10) Patent No.: US 7,141,810 B2
(45) Date of Patent: Nov. 28, 2006

(54) PARTICLE BEAM IRRADIATION SYSTEM

(75) Inventors: Shunji Kakiuchi, deceased, late of Mito (JP); by Akiko Kakiuchi, legal representative, Mito (JP); Kikuo Umegaki, Hitachinaka (JP); Kazuo Hiramoto, Hitachiohta (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 11/206,150

(22) Filed: Aug. 18, 2005

(65) Prior Publication Data

US 2006/0065855 A1 Mar. 30, 2006

(30) Foreign Application Priority Data

Sep. 28, 2004 (JP) ..... 2004-280803

(51) Int. Cl.
*G21K 5/10* (2006.01)
*H05H 9/00* (2006.01)

(52) U.S. Cl. ..... 250/492.3; 250/494.1; 250/505.1; 315/503; 315/505

(58) Field of Classification Search ..... 250/492.3
See application file for complete search history.

(56) References Cited

U.S. PATENT DOCUMENTS 6,580,084 B1 6/2003 Hiramoto et al.
6,683,318 B1 * 1/2004 Haberer et al. ..... 250/492.3
6,745,072 B1 * 6/2004 Badura et al. ..... 607/2
6,822,244 B1 * 11/2004 Beloussov et al. ..... 250/492.1
7,049,613 B1 * 5/2006 Yanagisawa et al. .... 250/492.3
2005/0127306 A1 * 6/2005 Yanagisawa et al. .... 250/492.1
2005/0167616 A1 * 8/2005 Yanagisawa et al. .. 250/492.22
2006/0065855 A1 * 3/2006 Kakiuchi et al. ..... 250/492.22

FOREIGN PATENT DOCUMENTS

JP 2001-85200 3/2001

* cited by examiner

*Primary Examiner*—John R. Lee
*Assistant Examiner*—Bernard E. Souw
(74) *Attorney, Agent, or Firm*—Dickstein Shapiro LLP

(57) ABSTRACT

A particle beam irradiation system which can increase an availability factor. An ion beam extracted from one proton beam linac is bent at 90 degrees by a switching magnet and is introduced to RI production equipment through a beam line. In the RI production equipment, a RI is produced using the introduced ion beam. An ion beam extracted from the other proton beam linac is bent at 90 degrees by the switching magnet and is introduced to a synchrotron through a beam line. The ion beam extracted from the synchrotron is irradiated to a patient from irradiation equipment. If one proton beam linac comes into an abnormal state, the one proton beam linac is stopped in operation and checked. During the check, the ion beam extracted from the other proton beam linac is selectively introduced to the RI production equipment and the synchrotron by the switching magnet.

3 Claims, 4 Drawing Sheets

PARTICLE BEAM IRRADIATION SYSTEM

BACKGROUND OF THE INVENTION

1. Field of the Invention

The present invention relates to a particle beam irradiation system. More particularly, the present invention relates to a particle beam irradiation system suitably used in not only inspection employing equipment of Positron Emission Tomography (hereinafter abbreviated to "PET") for producing a radioactive isotope (RI), e.g., fluorine 18, which is employed in a radioactive drug (hereinafter referred to as a "PET drug") and applied to a patient (subject) going to take the inspection, but also in treatment of cancers.

2. Description of the Related Art

As known in the art, proton-beam cancer treatment equipment used for treatment of cancers employs an ion beam accelerating system including a linear accelerator (linac) having an acceleration capability in the range of several to 10 MeV as a beam introducing unit and a synchrotron, or an ion beam accelerating system including a cyclotron. On the other hand, in equipment for producing the PET drug, a cyclotron (or a linear accelerator) having an acceleration capability in the range of 7 to several 10's MeV is employed to accelerate a proton beam and irradiate the accelerated beam against a target, thereby producing the radioactive isotope capable of radiating positrons.

Hitherto, a facility employing the proton-beam cancer treatment equipment and a facility employing the PET drug production equipment have been separately constructed corresponding to the fact that application fields of those equipments have been separated into treatment and diagnosis of cancers. With recent widespread use of the PET equipment and the proton-beam cancer treatment equipment, however, a demand has increased for a treatment plan capable of diagnosing the treatment effect with higher accuracy and further increasing the treatment effect. Such a demand has brought about a tendency to construct the proton-beam cancer treatment equipment and the PET equipment in combined layout. Because the half-life period of a RI (e.g., fluorine 18) used in the PET drug is very short, the PET equipment is required to include the PET drug production equipment, i.e., RI production equipment.

Patent Document 1; JP,A 2001-85200 discloses examples of combined layout of the proton-beam cancer treatment equipment and the RI production equipment. According to Patent Document 1, in a treatment system including a linear accelerator and a synchrotron, an ion beam extracted from the linear accelerator is introduced to the RI production equipment, thereby producing a RI. More specifically, the treatment systems disclosed in Patent Document 1 comprise the linear accelerator, the RI production equipment, and the synchrotron. The treatment system further comprises a switching magnet serving as a beam path switching unit and disposed downstream of the linear accelerator. The switching magnet introduces the ion beam extracted from the linear accelerator to the synchrotron or the RI production equipment. When the ion beam is irradiated to a patient, the ion beam extracted from the linear accelerator is introduced to the synchrotron by the switching magnet. The ion beam is accelerated in the synchrotron so as to have a preset level of energy and then irradiated to the patient. When the RI is produced, the ion beam extracted from the linear accelerator is introduced to the RI production equipment by the switching magnet and then irradiated to a target in the RI production equipment.

In a particle beam irradiation system disclosed in the above-cited Patent Document 1, the ion beam extracted from the linear accelerator is introduced to the synchrotron or the RI production equipment with the switching operation of the switching magnet.

SUMMARY OF THE INVENTION

In the known particle beam irradiation system described above, if any trouble occurs in the linear accelerator, check and repair of the linear accelerator must be performed in a shutdown state. Therefore, the treatment for patients using the ion beam cannot be continued. In addition, the RI production also cannot be continued and the diagnosis using the PET drug must be stopped.

Accordingly, it is an object of the present invention to provide a particle beam irradiation system capable of increasing an availability factor.

To achieve the above object, the particle beam irradiation system of the present invention comprises one first accelerator for generating a charged particle beam; another first accelerator for generating a charged particle beam; equipment for producing a radioactive isotope; a second accelerator; a beam path switching unit for introducing the charged particle beam extracted from the one first accelerator of the radioactive isotope production equipment and the second accelerator and for introducing the charged particle beam extracted from the other first accelerator to the radioactive isotope production equipment and the second accelerator; and irradiation equipment to which the charged particle beam extracted from the second accelerator is introduced.

Thus, the charged particle beam extracted from the one first accelerator can be introduced to one of the radioactive isotope production equipment and the second accelerator with the switching operation of the beam path switching unit, and the charged particle beam extracted from the other first accelerator can be introduced to the other of the radioactive isotope production equipment and the second accelerator with the switching operation of the beam path switching unit. Further, when one of the one first accelerator and the other first accelerator comes into an abnormal state, the charged particle beam can be selectively introduced to the radioactive isotope production equipment and the second accelerator from the remaining normal first accelerator. The first accelerator in the abnormal state can be checked while continuing the operation of the remaining normal first accelerator, whereby a shutdown period of the particle beam irradiation system can be shortened. It is therefore possible to increase the availability factor of the particle beam irradiation system.

With the present invention, since the first accelerator in the abnormal state can be checked while the remaining normal first accelerator is operated, the availability factor of the particle beam irradiation system can be increased.

DESCRIPTION OF THE PREFERRED EMBODIMENTS

Figure 1:
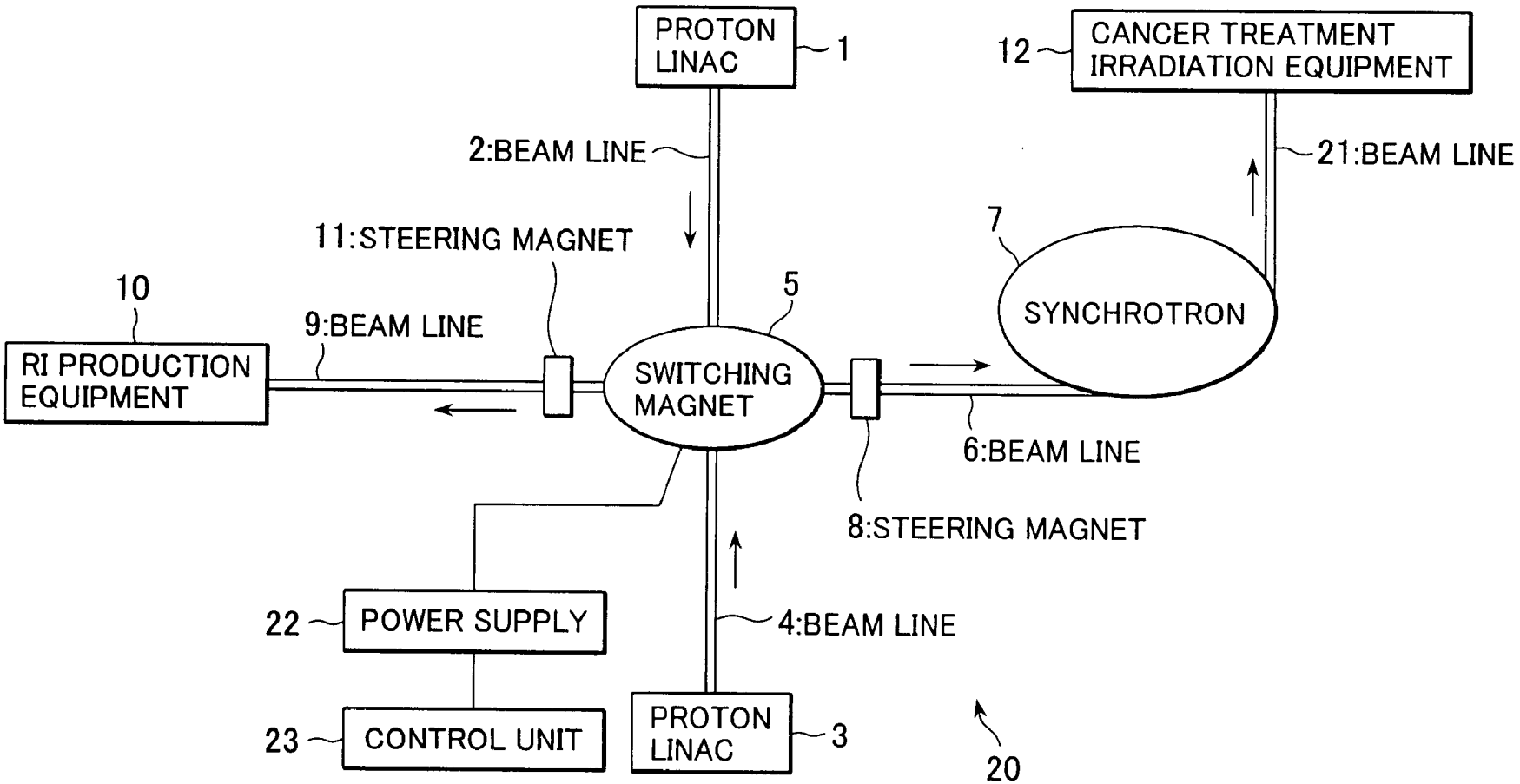
FIG. 1 is a block diagram of a proton beam irradiation system according to one preferred embodiment of the present invention.
Figure 2:
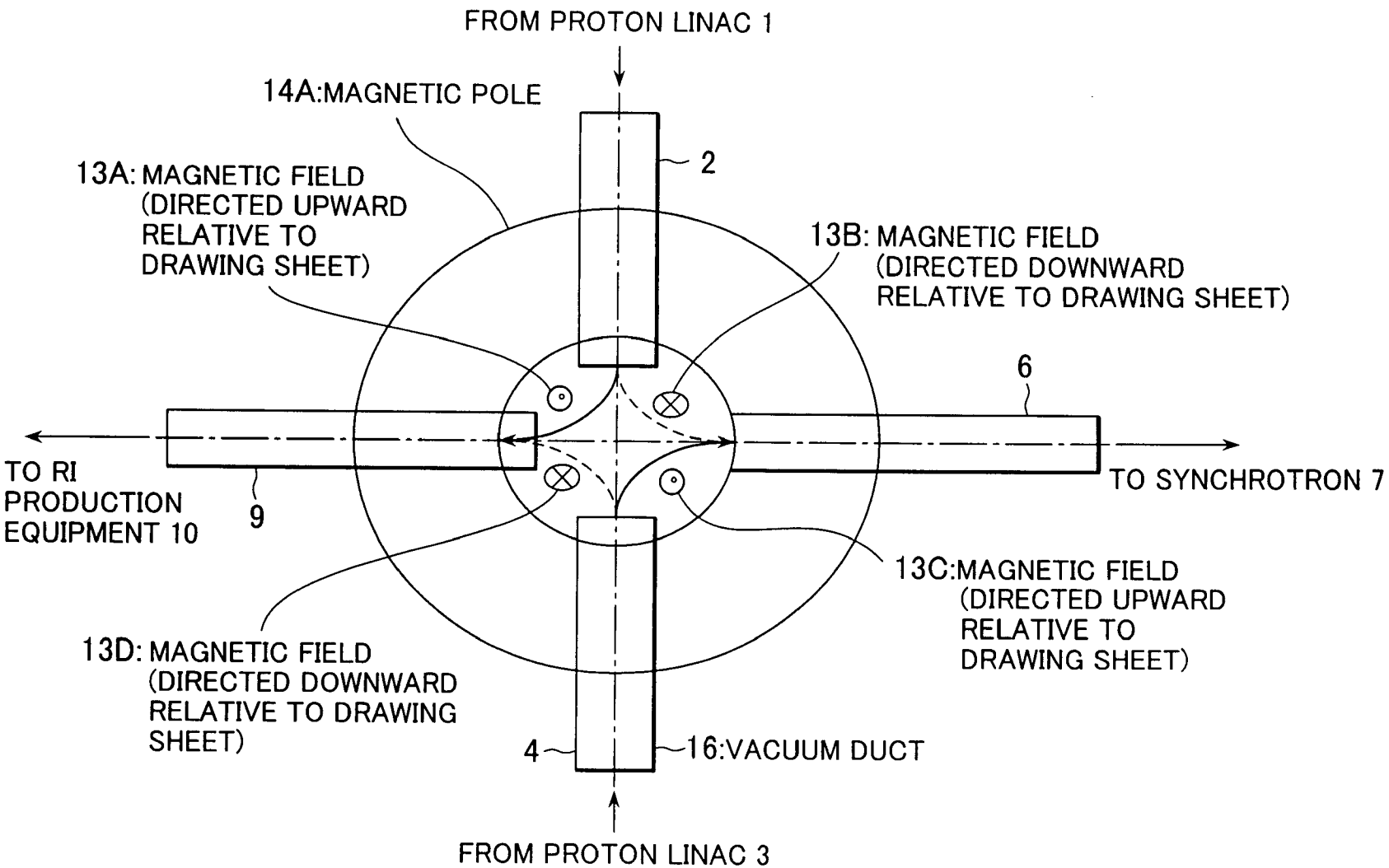
FIG. 2 is a schematic view for explaining a state of a magnetic field generated by a switching magnet shown in FIG. 1 and a state of an ion beam being bent by the switching magnet.
Figure 3:
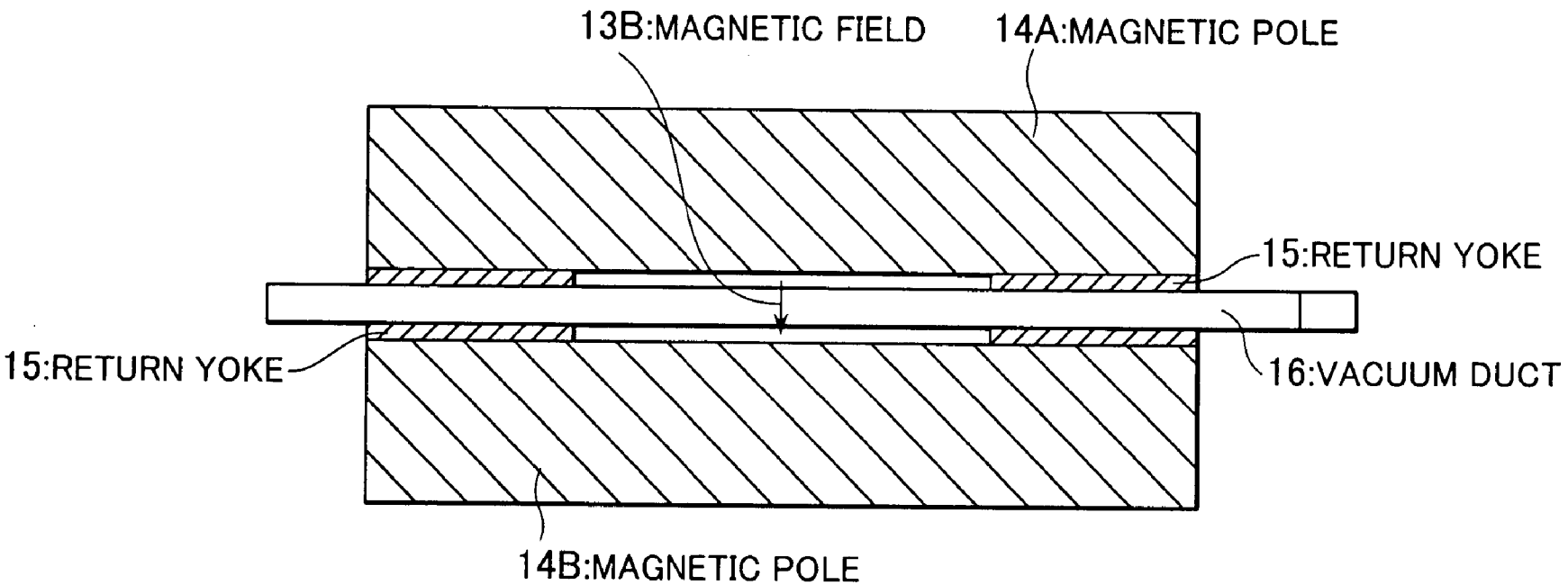
FIG. 3 is a vertical sectional view of the switching magnet.

A proton beam irradiation system, i.e., one kind of a particle beam irradiation system, according to one preferred embodiment of the present invention will be described below with reference to FIGS. 1–3. A proton beam irradiation system 20 of this embodiment comprises proton beam linacs (linear accelerator) 1, 3, a switching magnet 5, a unit of radioactive isotope production equipment (hereinafter referred to as a "RI production equipment") 10, a synchrotron 7, and a unit of irradiation equipment 12. Each of the proton beam linacs 1, 3 produces a proton beam of about 5–10 MeV. The proton beam linac 1 serving as a pre-stage accelerator is communicated with a beam line 2. The proton beam linac 3 is communicated with a beam line 4. A beam line 9 is communicated with the RI production equipment 10. A beam line 6 is communicated with the synchrotron 7. The synchrotron 7 serving as a main accelerator is communicated with the irradiation equipment 12 through a beam line 21. A steering magnet 8 is disposed in the beam line 6. A steering magnet 11 is disposed in the beam line 9. As shown in FIG. 2, the beam line 2 is selectively communicable with the beam lines 6, 9. Also, the beam line 4 is selectively communicable with the beam lines 6, 9.

The switching magnet 5 is made up of a plurality of laminated disk-shaped cores (magnetic poles) 14A, 14B and a return yoke 15. The return yoke 15 is sandwiched between the cores 14A and 14B which are arranged in vertically opposed relation. Coils (not shown) are wound over the cores 14A, 14B in the respective regions, as shown in FIG. 2, a region between the beam lines 2 and 9, a region between the beam lines 2 and 6, a region between the beam lines 4 and 9, and a region between the beam lines 4 and 6. Magnetic fields 13A, 13C directed upward relative to the drawing sheet, as shown in FIG. 2, represent magnetic fields in a normal state of the proton beam linacs 1, 3. Magnetic fields 13B, 13D directed downward relative to the drawing sheet, as shown in FIG. 2, represent magnetic fields in an abnormal state of the proton beam linacs 1 or 3. Actually, as not shown in FIG. 2, the magnetic fields 13B, 13D are directed upward relative to the drawing sheet in the former normal state, and the magnetic fields 13A, 13C are directed downward relative to the drawing sheet in the latter abnormal state.

Vacuum ducts 16 constituting the beam lines 2, 4, 6 and 9 are disposed between the magnetic poles 14A and 14B. The vacuum duct 16 of the beam line 2 and the vacuum duct 16 of the beam line 4 are arranged so as to lie on a straight line with respective duct ends positioned to face each other. The vacuum duct 16 of the beam line 6 and the vacuum duct 16 of the beam line 9 are arranged so as to lie on a straight line extending in a direction perpendicular to the vacuum duct 16 of the beam line 2 with respective duct ends positioned to face each other.

The return yoke 15 has cutouts formed therein in such a pattern as allowing an ion beam to be introduced from the vacuum duct 16 of the beam line 2 to the vacuum ducts 16 of the beam lines 6, 9, and allowing an ion beam to be introduced from the vacuum duct 16 of the beam line 4 to the vacuum ducts 16 of the beam lines 6, 9. Each of those cutouts serves as a passage region (path) of the ion beam.

The coils wound over the above-mentioned respective regions of the cores 14A and 14B are connected to a power supply 22. The proton beam irradiation system 20 has a control unit 23 for outputting a control signal to the power supply 22. The control signal is a signal for switching the direction in which a current flows through each coil.

The operation of the proton beam irradiation system 20 will be described below. In a normal state of the proton beam linac 1, 3, a current is supplied from the power supply 22 to each coil of the switching magnet 5 in accordance with the control signal from the control unit 23, whereby the magnetic fields 13A, 13B, 13C and 13D directed upward relative to the drawing sheet are formed as above mentioned. Therefore, the ion beam extracted from the proton beam linac 1 passes through the beam line 2 and is bent at 90 degrees into a direction toward the beam line 9 under the action of the switching magnet 5. Then, the ion beam is introduced to the RI production equipment 10 through the beam line 9. In the RI production equipment 10, the ion beam is irradiated to a target substance, to thereby produce a RI (e.g., fluorine 18). The ion beam extracted from the proton beam linac 3 passes through the beam line 4 and is bent at 90 degrees into a direction toward the beam line 6 under the action of the switching magnet 5. Then, the ion beam is introduced to the synchrotron 7 through the beam line 6. The ion beam is further accelerated by the synchrotron 7 until reaching a preset level of energy. After reaching the preset level of energy, the ion beam is extracted from the synchrotron 7 to the beam line 21 and then introduced to the irradiation equipment 12. Finally, the ion beam is irradiated from the irradiation equipment 12 to an affected part in the body of a patient (not shown).

If the proton beam linac 3 comes into an abnormal state (for example, if any trouble occurs), the operation of the proton beam linac 3 is stopped and check of the proton beam linac 3 is performed. Correspondingly, the introduction of the ion beam from the proton beam linac 3 to the synchrotron 7 is also stopped. Therefore, treatment for the patient using the ion beam from the proton beam linac 3 cannot be continued any more. The control unit 23 receives a signal indicating an abnormality of the proton beam linac 3 and regulates the power supply 22 in accordance with the received signal such that the directions of currents supplied to the respective coils of the switching magnet 5 are changed to directions opposed to those set in the above-described normal state. With such a change in the current direction, all of the magnetic fields 13A, 13B, 13C, and 13D are directed downward relative to the drawing sheet. Then, the ion beam extracted from the proton beam linac 1 is introduced from the beam line 2 to the beam line 6 by the switching magnet 5 in which the above-mentioned magnetic fields 13A and 13B are formed, followed by being introduced to the synchrotron 7. The ion beam accelerated by the synchrotron 7 is irradiated to the patient through the irradiation equipment 12.

Subsequently, the control unit 23 controls the power supply 22 such that the magnetic fields 13A, 13B, 13C, and 13D formed by the switching magnet 5 are directed upward relative to the drawing sheet, whereby even in the abnormal state of the proton beam linac 3, the ion beam extracted from the proton beam linac 1 is introduced to the RI production equipment 10 and irradiated to the target substance set in the RI production equipment 10. The supply of the ion beam from the proton beam linac 1 to the RI production equipment 10 is performed except for a period in which the ion beam is introduced from the proton beam linac 1 to the synchrotron 7 for irradiation to the patient. During the period in which the ion beam is introduced from the proton beam linac 1 to the synchrotron 7, the ion beam line is not introduced to the RI production equipment 10 with the switching operation of the switching magnet 5.

In the above description, the switching magnet 5 serves as a beam path switching unit for selectively introducing the ion beams from the proton beam linacs 1, 3 to the synchrotron 7 and the RI production equipment 10.

While the ion beam is selectively supplied to the synchrotron 7 and the RI production equipment 10 from the proton beam linac 1 alone, the proton beam linac 3 in the abnormal state is checked and the cause of the trouble in the proton beam linac 3 is eliminated so that the operation of the proton beam linac 3 can be restarted. With this embodiment, therefore, it is possible to check one proton beam linac in the abnormal state while the other proton beam linac is operated, and to shorten a shutdown time of the proton beam irradiation system 20. As a result, the availability factor of the proton beam irradiation system 20 can be increased. In particular, by installing the proton beam linacs 1, 3 in respective shielded rooms separated from each other, the check of one proton beam linac can be performed with safety even during the operation of the other proton beam linac, i.e., in a manner of surely preventing workers from being exposed to radiations generated from the proton beam linac under the operation.

Since the ion beam from each of the proton beam linacs 1, 3 can be introduced to the synchrotron 7 or the RI production equipment 10 by the switching magnet 5 having a compact structure, the construction of the proton beam irradiation system 20 can also be made compact.

By using proton beam linacs of the same type to constitute the proton beam linacs 1, 3, components such as driving power supplies, excavation systems and controllers are in common with both the proton beam linacs. Accordingly, spare parts and consumable parts are also in common with them.

After the check is completed and the proton beam linac 3 having been repaired to be free from the abnormal state is restarted in operation, the proton beam irradiation system 20 is operated such that the ion beam extracted from the proton beam linac 1 is introduced to the RI production equipment 10 by the switching magnet 5 and the ion beam extracted from the proton beam linac 3 is introduced to the synchrotron 7 by the switching magnet 5, as described above in connection with the normal state.

Figure 4:
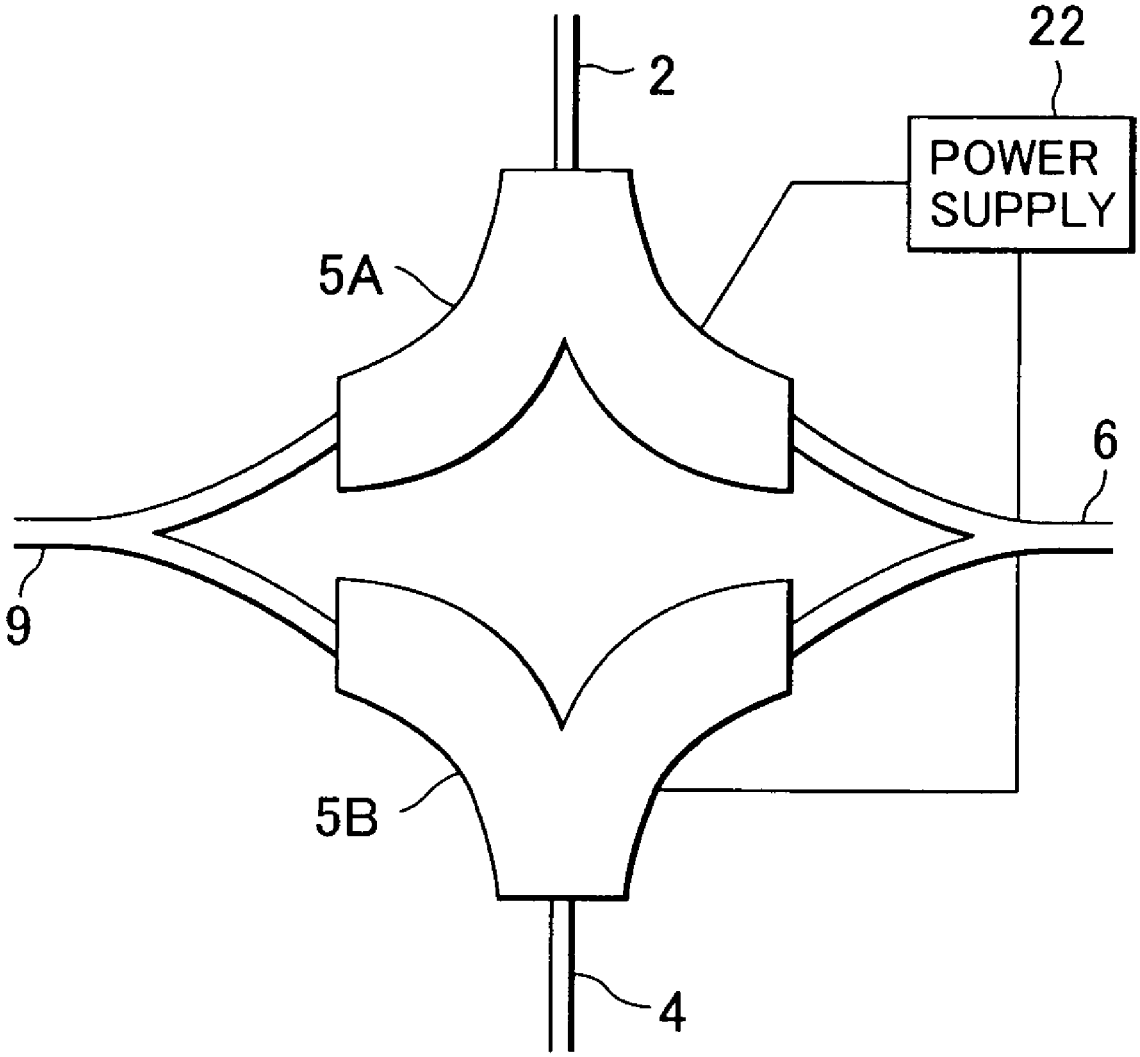
FIG. 4 is a schematic view showing the vicinity of the switching magnet in a proton beam irradiation system according to another embodiment of the present invention.

A proton beam irradiation system according to another embodiment of the present invention will be described below with reference to FIG. 4. In a proton beam irradiation system 20A of this embodiment, the switching magnet 5 in the above-described embodiment is replaced with a pair of switching magnets 5A, 5B as shown in FIG. 4. The remaining construction of the proton beam irradiation system 20A of this embodiment is the same as that of the proton beam irradiation system 20 described above. The ion beam extracted from the proton beam linac 1 is introduced from the beam line 2 to the beam line 9 (or the beam line 6) by the switching magnet 5A. The ion beam extracted from the proton beam linac 3 is introduced from the beam line 4 to the beam line 6 (or the beam line 9) by the switching magnet 5B. The ion beam having reached the beam line 9 is introduced to the RI production equipment 10, and the ion beam having reached the beam line 6 is introduced to the synchrotron 7.

Each of the switching magnets 5A, 5B comprises a pair of bending magnets. By supplying a current to a coil of one of the pair of bending magnets constituting each of the switching magnets 5A, 5B in a direction opposed to the direction of a current supplied to the other bending magnet such that both the bending magnets generate magnetic fields directed opposite to each other, it is possible to bend the ion beam toward one of the paired bending magnets (for example, from the beam line 2 to the beam line 9 or from the beam line 4 to the beam line 6). Excitation currents are supplied from the power supply 22 to the paired bending magnets of each of the switching magnets 5A, 5B. By changing the directions of those excitation currents to be opposed to those in the preceding state, each of the switching magnets 5A, 5B is able to introduce the ion beam toward the beam line on the opposite side (for example, from the beam line 2 to the beam line 6 or from the beam line 4 to the beam line 9). The control unit 23 can change the beam line to which the ion beam is introduced, by regulating the power supply 22 so as to switch over the excitation currents supplied to each of the switching magnets 5A, 5B. Similarly to the switching magnet 5, each of the switching magnets 5A, 5B constitutes the beam path switching unit.

While the proton beam is used in any of the above-described embodiments, a heavy particle beam, such as a carbon ion beam, may also be used instead.

What is claimed is:

1. A particle beam irradiation system comprising:

one first accelerator for generating a charged particle beam;

another first accelerator for generating a charged particle beam;

equipment for producing a radioactive isotope;

a second accelerator;

a beam path switching unit for introducing the charged particle beam extracted from said one first accelerator to said radioactive isotope production equipment and said second accelerator and for introducing the charged particle beam extracted from said other first accelerator to said radioactive isotope production equipment and said second accelerator, to thereby increase the availability factor of the particle beam irradiation system; and irradiation equipment to which the charged particle beam extracted from said second accelerator is introduced.

2. The particle beam irradiation system according to claim 1, further comprising a control unit for changing polarities of a switching magnet constituting said beam path switching unit, thereby bending the charged particle beam from a direction toward one of said radioactive isotope production equipment and said second accelerator to a direction toward the other.

3. The particle beam irradiation system according to claim 2, wherein when one of said one first accelerator and said other first accelerator is in an abnormal state, said control unit changes the polarities of said switching magnet such that the charged particle beam extracted from the remaining normal first accelerator is selectively introduced to said radioactive isotope production equipment and said second accelerator.

* * * * *